United States Patent [19]

Baldwin

[11] 4,244,792

[45] Jan. 13, 1981

[54] METHOD FOR STRIPPING ANODIZED ALUMINUM AND ALUMINUM ALLOYS

[75] Inventor: Philip C. Baldwin, El Segundo, Calif.

[73] Assignee: Hixson Metal Finishing, Newport Beach, Calif.

[21] Appl. No.: 124,866

[22] Filed: Feb. 26, 1980

[51] Int. Cl.[3] ..... C23G 1/12; C25D 11/04

[52] U.S. Cl. ..... 204/58; 134/3; 134/41

[58] Field of Search ..... 204/58, 146; 134/41, 134/3, 36

[56] References Cited

U.S. PATENT DOCUMENTS

| | | | |
|---|---|---|---|
| 2,650,157 | 8/1953 | Cochran | 134/41 |
| 2,687,346 | 8/1954 | McDonald | 134/41 |
| 3,326,803 | 6/1967 | Kelley et al. | 134/41 |
| 3,692,583 | 8/1972 | Mucenieks et al. | 134/41 |
| 3,696,044 | 10/1972 | Rutledge | 134/41 |

*Primary Examiner*—R. L. Andrews

*Attorney, Agent, or Firm*—Gausewitz, Carr, Rothenberg & Edwards

[57] ABSTRACT

A method is described for the controlled removal of anodized oxide layers from the surfaces of aluminum and aluminum alloys, without destruction of the metal. The preferred method uses an aqueous solution of oxalic acid and nitric acid as an oxide stripping bath.

15 Claims, No Drawings

METHOD FOR STRIPPING ANODIZED ALUMINUM AND ALUMINUM ALLOYS

BACKGROUND OF THE INVENTION

This invention relates to methods for removing metal oxides from the surfaces of metallic objects composed of aluminum or aluminum alloys. More particularly, it relates to methods for removing layers of oxides formed on aluminum-containing metals in anodizing processes.

It is well known to anodize aluminum and aluminum alloys to render their surfaces more resistant to corrosion and abrasion and to enhance their appearance. Also, anodizing the surfaces before painting them greatly improves the adhesion between the surfaces and the paint, rendering the paint less susceptible to peeling our weathering.

There are various methods for anodizing metallic objects composed principally of aluminum and aluminum alloys. All of them involve electrolytically forming a metal oxide coating on the surfaces of the objects by employing the objects as anodes in electrolytic cells. The electrolytic cells typically use as electrolytes aqueous solutions of chromic acid or sulfuric acid, although other acids, such as oxalic acid, boric acid, sulfamic acid, sulfosalicylic acid, sulfophthalic acid, or sometimes mixtures of acids, have also been used.

In a typical anodizing process the metallic object to be anodized is attached to, or suspended from, a rack or carrier and submerged in the electrolyte bath. An electric circuit is completed between the rack, which extends upwardly out of the bath, and a cathode, typically of lead, which is positioned in the bath, spaced apart from the metallic object and rack. The electrolyte bath composition and temperature are controlled, depending upon the precise characteristics of anodic coating desired to be formed on the metallic object.

An oxidation reaction occurs at the anode (i.e., the metallic object and rack), building up a layer of metal oxide, principally aluminum oxide (depending on the composition of the aluminum alloy), which may range in thickness from a fraction of a mil, e.g., 0.00005 inch, or even thinner, to as much as 0.004 inch, or even thicker, depending on the use to which the metallic object is to be put. the efficiency of the anodizing process depends greatly on the electrical resistance in the electrolytic circuit, and this in turn depends on the conductivity of the various components. The aluminum oxide layer itself is a very poor conductor, and, thus, as it builds up on the metallic object and the rack which carriers the object, the efficiency drops off.

The condition of the rack and the nature of the contact between the rack and the metallic object are critical fractors affecting anodizing efficiency. Thus, an ideal rack should be composed of highly conductive material. Yet is must be inexpensive and capable of being formed in various configurations to secure the metallic objects during anodizing, provide maximum surface contact with the metallic objects for current flow, and be capable of fast, efficient loading and unloading. Typically, aluminum or aluminum alloys are used for racks, since they can be economically manufactured in myriad configurations, and they have excellent electrical conductivity. For example, a rack may have numerous pairs of prongs, each of which possesses sufficient resiliency to securely hold a metallic object inserted between them. A number of metallic objects can be rapidly loaded on such racks, and they can then be moved and positioned in the electrolyte bath for the anodizing operation, and later the rack can be removed and the metallic objects quickly unloaded. Other types of racks may employ clamps or other fastening means to securely hold the objects in position during anodizing.

Whatever configuration of rack has been used, it has been found that anodizing efficiency drops to intolerably low levels when the rack itself becomes anodized, i.e., coated with an insulating layer of axides. Thus, it has been found essential to treat the racks to deanodize them, i.e., strip off the oxide layer, after each anodizing operation. A complete cycle in an anodizing process thus involves loading and mounting metallic objects on conductive racks, installing the racks in the electrolytic bath and closing the elctrolytic circuit, leaving the racks in the bath for a sufficient time for a layer of oxide of predetermined thickness to form on the objects, removing the racks from the bath, conducting any finishing operations desired (such as washing and sealing the surfaces of the anodized objects), removing the objects from the racks, and treating the racks to deanodize them. The cycle can then begin again by loading a new set of metallic objects to be anodized on the deanodized racks.

The efficiency of the deanodizing step, where the oxide layer is stripped from the racks, can be critical, since it may be a bottleneck for the entire anodizing process cycle.

A similar problem which seriously affects overall process efficiency occurs when metallic objects acquire defective anodized layers. This may occur for numerous reasons ranging from variations in anodizing conditions to accidental scratching of anodized surfaces or even to physical anomalies of a particular metallic object. Whatever the cause, it is sometimes necessary to deanodize the object in the same manner that the racks are deanodized, i.e., by treating the surface to remove the oxide layer. The efficiency of the entire process or plant may, thus, be related directly to the efficiency of the deanodizing step.

The common techniques for deanodizing racks and other metallic objects for reuse in an anodizing process involve soaking or treating them in stripping solutions, such as aqueous mixtures of phosphoric acid and chromic acid and, in some instances, nitric acid, maintained at the boiling point, approximately 212° F., for a time sufficient to dissolve the oxide layer.

All of the prior art techniques suffer one or more deficiencies which have heretofore defied all attempts to solve. For example, by-products of these prior art deanodizing processes may include large quantities of insoluble deposits, apparently containing reaction products of the acids and the aluminum or alloy metals in the racks and metal objects, as well as any metals in the walls of the stripper bath tank (which may typically be of stainless steel). Some of these deposits not only interfere with heat transfer, but also form hard, dense layers on the stripper tank walls which adhere so tenaciously that they cannot be chipped away without damage to the walls. Periodically it may even be necessary to simply discard an entire stripping tank and replace it. Even when the tank walls are susceptible to being cleaned and reused, the task may be so time-consuming and expensive as to render it impractical.

The high stripping temperature involved in prior art techniques also presents problems not only of economy, but also of safety and the need for close attention, and it has long been felt that a stripper that could be efficiently operated at lower temperatures would be highly desirable.

Another problem with prior art stripping solutions has been that they typically are, or become, opaque, and it is not feasible visually to monitor the progress of the deanodizing operation. The solutions are also expensive, and it has long been desired to provide the art with a deanodizing solution that would use only relatively inexpensive ingredients.

A most serious problem of prior art techniques has been that the presence of chromium compounds has made it extremely burdensome to dispose of spent solutions, due to the risk of environmental pollution. Accordingly, there has been a long felt need to provide a stripping technique in which the by-products and spent solutions could be safely disposed of without hazard to the environment.

Prior art stripping solutions are also somewhat sensitive to the particular aluminum alloy being treated or to the type of anodizing the alloy has been subjected to, so that appropriate stripping times and conditions may be unpredictable and require trial-and-error determination.

SUMMARY OF THE INVENTION

This invention contemplates a method for deanodizing a metallic object composed of aluminum or aluminum alloys by submerging the object in a stripping solution comprising an aqueous solution of oxalic acid and nitric acid for a time sufficient to substantially remove the anodized layer of metal oxide coating from the object, but insufficient to significantly attack the metal beneath the coating. The stripping solution ranges in concentration from about 1.5% to 20%, by weight, oxalic acid, and about 3% to 50%, preferably 3% to 20%, by weight, nitric acid, and is maintained at elevated temperatures ranging from about 120° F. to 212° F., preferably 120° F. to 160° F.

The metallic object to be deanodized is submerged in the solution for a time sufficient to remove the oxide layer, generally ranging from about 5 to about 60 minutes, and preferably from about 15 to about 30 minutes. The precise length of time depends upon the thickness of the oxide layer, and the temperature and concentration of the stripping solution, and can be readily determined by observation or by minimal experimentation.

DETAILED DESCRIPTION OF THE INVENTION

The method of the invention is illustrated in the following examples using equipment and parts from a commercial scale anodizing and stripping process.

A stripping solution bath, prepared in accordance with the invention, is batch-mixed in a stainless steel stripping tank as follows:

Deionized water is added to the tank, which is externally heated by gas-firing to maintain the water at a temperature within the range from about 140° F. to about 160° F.;

One hundred fifty pounds of nitric acid (70 wt.% in aqueous solution) is added to the deionized water;

One hundred pounds of oxalic acid ($H_2C_2O_4.2H_2O$) is then dissolved in the nitric acid and water solution.

The amount of deionized water used is adjusted to make a total stripping solution volume of approximately 380 gallons. The solution is sufficiently clear that the bottom of the tank can be clearly observed through several feet of solution.

To test the stripping efficiency of the solution, conventional racks from a commercial sulfuric acid anodizing process are suspended in the stripping tank and submerged in the solution. The racks are composed of type 6061 aluminum alloy and typically have a substantially uniform anodized coating approximately 0.002 inch thick over their surfaces. Within fifteen minutes the surfaces are visually observed to be clear of the anodized layer and are removed from the stripping bath and rinsed in water. Upon reuse in the anodizing process, it is observed that the conductive efficiency of the racks is indistinguishable from that of new racks which have never previously been anodized.

Similar tests show that substantially identical results are obtained using aluminum alloy racks which have been anodized in a chromic acid anodizing process. It is observed that the stripping bath efficiency is substantially the same as with the sulfuric acid anodized racks.

By way of comparison, it has been found that conventional stripping baths of aqueous solutions of phosphoric and chromic acid require approximately 30 minutes, or even more, to strip anodized layers of comparable thickness to the foregoing, even when maintained at boiling temperatures. Furthermore, the conventional solutions are dark and opaque and render it impossible to visually observed the progress of the stripping operation without periodically removing the racks from the bath.

Batches of stripping solutions of this invention have been used essentially continuously for several weeks in commercial operations by periodically adding sufficient additional oxalic acid, or mixtures of oxalic and nitric acid, to maintain the acidic normality between approximately 1.0 and 1.3. Even after sufficient aluminum oxide has been dissolved in the solution during the stripping operations to provide over 60 pounds of aluminum in the 380 gallons of solution, it has been found that essentially no sediment or insoluble deposits have formed. The entire contents of the bath can be drained and disposed of simply by neutralizing it, e.g., with sodium hydroxide, to render it environmentally innocuous. The tank can then be refilled, without the necessity for any cleaning or scraping of the walls or bottom.

The stripping solutions prepared in accordance with this invention have been found to be highly selective to the anodized coating, and they present no excessive tendency to attack the underlying aluminum or aluminum alloys or the walls of the stainless steel tank. Thus, even after many months of use, the stainless steel tanks show virtually no sign of corrosion from the stripping solution. Even more important, when, through operator error or otherwise, the racks or other metallic objects are left too long in the stripping solution, even twice as long as required to dissolve the oxide layer, it is found that dimensional loss due to attack on the underlying metal is too small to be measured.

While the stripping process of this invention may be applied to many alloys, its use is especially contemplated for stripping anodized aluminum or alloys containing over 90 wt.%, preferably over about 93 wt. %, aluminum.

Many other uses and variations of the invention will be apparent to those skilled in the art, and while specific embodiments of this invention have been described, these are intended for illustrative purposes only. It is intended that the scope of the invention be limited only by the attached claims.

I claim:

1. A method for removing metal oxides from the surfaces of aluminum-containing metal objects comprising:

providing an aqueous solution comprising nitric acid and oxalic acid, and contacting the surfaces of said metal objects with said aqueous solution for a time sufficient to remove said metal oxides therefrom.

2. A method as recited in claim 1 wherein said aluminum-containing metal objects are comprised of metals selected from the group consisting of aluminum and alloys of aluminum containing at least about 90 wt.% aluminum.

3. A method as recited in claim 2 wherein said aqueous solution contains from about 1.5% to about 20%, by weight, of said oxalic acid.

4. A method as recited in claim 2 wherein said aqueous solution contains from about 3% to about 50%, by weight, nitric acid.

5. A method as recited in claim 4 wherein said aqueous solution contains from about 3% to about 20%, by weight, nitric acid.

6. A method as recited in claim 2 wherein said aqueous solution is maintained at temperatures in the range from about 120° F. to about 212° F. during said contacting with said surfaces.

7. A method as recited in claim 6 wherein said aqueous solution is maintained at temperatures in the range from about 120° F. to about 160° F. during said contacting with said surfaces.

8. A method for removing oxide layers from the surfaces of an anodized metallic object containing at least about 90%, by weight, aluminum comprising:

providing an aqueous stripping solution comprising from about 1.5% to about 20%, by weight, oxalic acid and about 3% to about 50%, by weight, nitric acid, maintaining said solution at temperatures in the range from about 120° F. to about 212° F., and submerging said object in said solution for a time sufficient to substantially remove said oxide layers therefrom.

9. A method as recited in claim 8 wherein said layers range in thickness from about 0.00005 inch to about 0.004 inch and said time ranges from about 5 minutes to about 60 minutes.

10. A method as recited in claim 8 wherein said stripping solution comprises from about 3% to about 20%, by weight, nitric acid.

11. A method as recited in claim 10 wherein said temperature ranges from about 120° F. to about 160° F. and said object is submerged therein for a time ranging from about 15 minutes to about 30 minutes.

12. A method for stripping anodized oxide layers from an anodized aluminum-containing metal object comprising:

submerging said object in aqueous stripping solution containing from about 1.5% to about 20%, by weight, oxalic acid, and from about 3% to about 20%, by weight, nitric acid, for a time ranging from about 15 minutes to about 30 minutes, and maintaining said solution at temperatures in the range from about 120° F. to about 160° F. while said object is submerged therein.

13. In an anodizing process which includes the steps of securing a metallic object composed of a member selected from the group consisting of aluminum and aluminum alloys containing at least about 90 wt.% aluminum on racks comprised of a member selected from the group consisting of aluminum and alloys of aluminum containing at least about 90 wt.% aluminum, employing said rack and mounted metallic object as an anode in an electrolytic cell by submerging said rack and metallic object in an electrolyte solution of said cell for a time sufficient to anodize the surfaces of said rack and metallic object, withdrawing said rack and metallic object from said electrolyte, removing the anodized metallic object from said rack, deanodizing the surfaces of said rack by submerging it in a stripping bath, and reusing the deanodized rack to mount additional metallic objects thereon for anodizing, the improvement comprising:

employing as said stripping bath an aqueous solution comprising nitric acid and oxalic acid.

14. The improvement recited in claim 13 wherein said aqueous solution comprises from about 3% to about 20%, by weight, nitric acid and from about 1.5% to about 20%, by weight, oxalic acid.

15. The improvement recited in claim 14 wherein said aqueous solution is maintained at temperatures in the range from about 120° F. to about 160° F. and said rack is deanodized by submerging it in said aqueous solution for a time ranging from about 15 minutes to about 30 minutes.

* * * * *